US005864900A

United States Patent [19]

Landau

[11] Patent Number: 5,864,900

[45] Date of Patent: Feb. 2, 1999

[54] PATIENT-PROTECTIVE SIDE PANEL FOR BEDS

[76] Inventor: James Landau, Marsh Rd., Northfield, Conn. 06778-2118

[21] Appl. No.: 5,572

[22] Filed: Jan. 12, 1998

[51] Int. Cl.[6] ..... A47C 21/68

[52] U.S. Cl. ..... 5/424; 5/425; 5/430; 5/663

[58] Field of Search ..... 5/424, 425, 430, 5/663, 93.1, 97, 100

[56] References Cited

U.S. PATENT DOCUMENTS 2,738,523 3/1956 Bryant ..... 5/425
3,344,445 10/1967 Crawford ..... 5/430
4,612,679 9/1986 Mitchell ..... 5/430
4,839,933 6/1989 Plewright et al. ..... 5/430 X

*Primary Examiner*—Michael F. Trettel
*Attorney, Agent, or Firm*—Dallett Hoopes

[57] ABSTRACT

A vertical panel is adapted to extend along at least one side of the bed and be secured to the usual sickbed side bars. The panel comprises a lower and an upper section with proximate edges of the respective sections meeting in a horizontal hinge line. The upper and lower sections are each rigid and are normally coplanar. Along the hinge line the panels are connected by at least one hinge which includes a bias adapted to bias the panels in coplanar condition but permitting the upper section to pivot and collapse inwardly of the bed about the hinge line.

9 Claims, 1 Drawing Sheet

FIG. 1
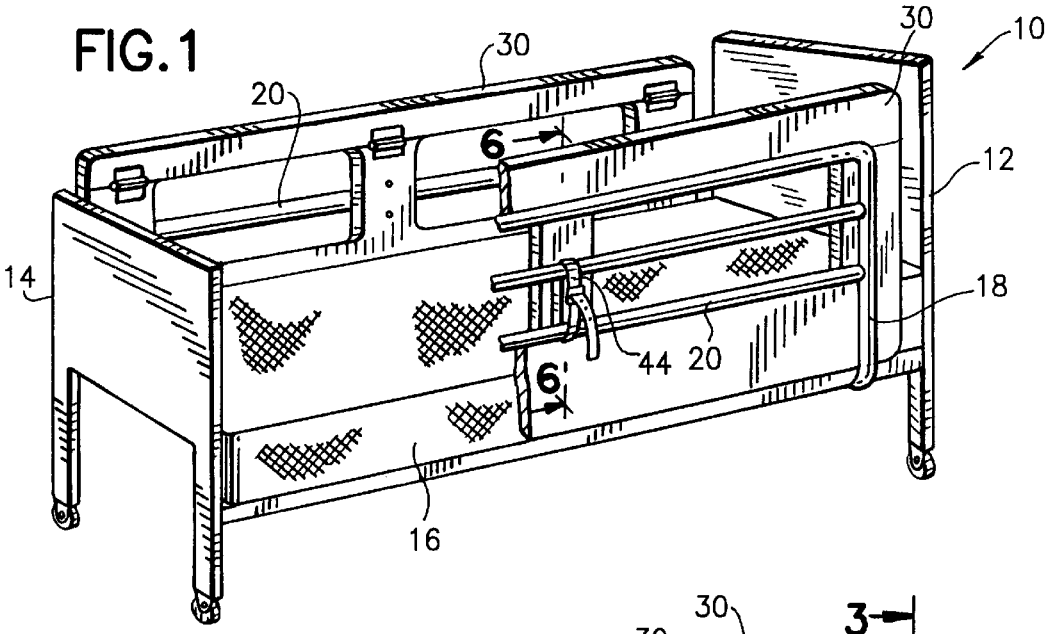
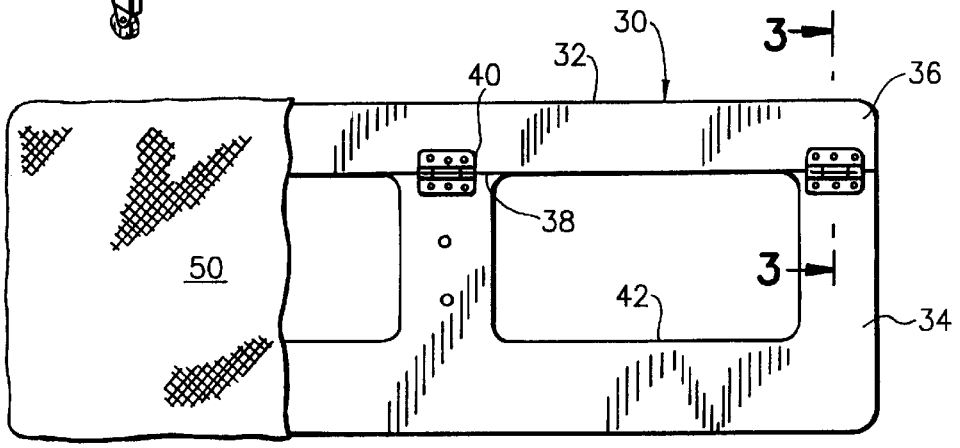
FIG. 2
FIG. 3
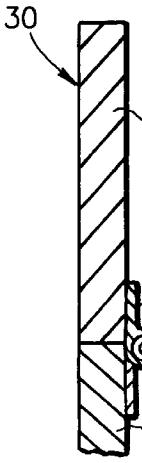
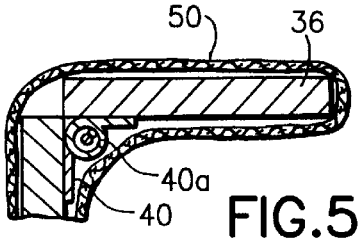
FIG. 5
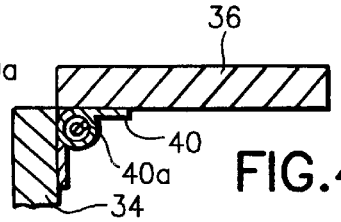
FIG. 4
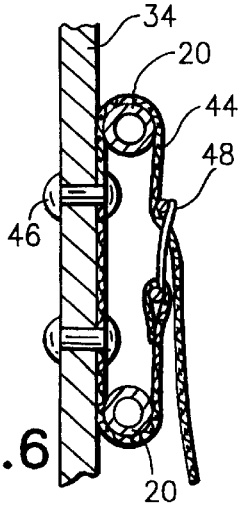
FIG. 6

PATIENT-PROTECTIVE SIDE PANEL FOR BEDS

FIELD OF THE INVENTION

This invention relates to patient protection devices. More specifically, the invention relates to a device for inhibiting patients from climbing out of bed.

BACKGROUND OF THE INVENTION

Heretofore, it has been the unfortunate practice in nursing homes in the treatment of mentally impaired patients—such as those suffering from Alzheimer's disease—to physically hold such patients to keep them from climbing out of bed. Such holding has involved straps and other physical retains which have immobilized the upper limbs or torso of the patient. Alternatively, patients have been given medication to quiet them down and impair their desire to leave the bed.

Either of these alternatives has led to severe frustration to the patient or, in the case of drugs, serious side effects over a period of time.

The present invention replaces prior barbaric treatment with a more humane approach, namely kinder, gentler means for discouraging the patient from climbing out of bed.

SUMMARY OF THE INVENTION

The invention is a vertical panel adapted to extend along at least one side of the bed and be secured to the usual bed side bars. The panel comprises a lower and an upper section with proximate edges of the respective sections meeting in a horizontal hinge line. The upper and lower sections are each rigid and are normally coplanar. Along the hinge line the panels are connected by at least one hinge which includes a bias adapted to urge the panels into coplanar condition but permitting the upper section, when pulled inward, to pivot and collapse inwardly of the bed about the hinge line.

Thus, when the patient, lying on his back, attempts to grasp the top edge of the upper section of the panel in order to use it to climb out of bed, the upper section pivots and does not support his hand in sturdy enough fashion to enable him to climb over the panel. When the patient releases the top edge, the bias pivots the upper section back to the planar position.

BRIEF DESCRIPTION OF THE DRAWINGS

Further objects and features of the invention will be clear to those skilled in the art from a review of the following specification and drawings, all of which present a non-limiting form of the invention. In the drawings:

FIG. 1 is a perspective view of a bed having panels embodying the invention secured against the respective side bars. Portions of the foreground side bars and panel are broken away to reveal the panel on the far side;

FIG. 2 is a front elevation of a panel embodying the invention and showing in part a cover used to protect the patient from portions of the panel;

FIG. 3 is an enlarged fragmentary view taken on the line 3—3 of FIG. 2;

FIG. 4 is similar to FIG. 3 but showing the upper section pivoted;

FIG. 5 is a view similar to FIG. 4 but including a sectional view of a cover; and FIG. 6 is a fragmentary view taken on the line 6—6 of FIG. 1.

DESCRIPTION OF THE PREFERRED EMBODIMENT

A bed having panels embodying the invention is shown in FIG. 1 and generally designated 10. It comprises a headboard 12 including legs and a footboard 14. These elements support a spring structure (not shown) on the top of which is disposed a mattress 16. This structure is normally equipped in a hospital, for instance, by a system 18 of side bars which may be a plurality of spaced horizontal bars 20.

A panel 30 embodying the invention is shown vertically disposed against the inside of the side bars 120 on both sides of the bed. The panel includes a top horizontal edge 32 (FIG. 2) and comprises a lower section 34 and an upper section 36. The sections are rigid and can be made of a sheet of plywood, recyclable plastic such as polyvinylchloride (PVC) or the like or any other sheet material having substantial strength and a smooth outer surface.

The lower and upper sections 34, 36 are normally coplanar and their proximate edges of the respective sections meet in a horizontal hinge line 38. There the proximate edges are hinged together by at least one hinge 40 disposed on the inward side of the panel with respect to the bed. The hinges are preferably of the spring type wherein an axial spring surrounds the hinge pin and urges the leaves apart to an opened condition whereat the sections are coplanar. The biasing means may be in the form of springs attached to the sections on the outside of the panel separate from the hinges, but the well-known spring hinges—similar to those used on screen doors—is preferred.

The panel is formed with lightening holes 42 for the purpose of reducing the weight of the panel and making it easier to lift. The upper margin of the lightening holes 42 may coincide with the hinge line 38 (FIG. 2).

As shown in FIGS. 1, 2 and 6, a strap 44 may be secured as by rivets 46 to the panel 30 between the lightening holes 42. The strap preferably loops over a plurality of side bars 20 and is secured with a buckle 48 by which it may be firmly supported by the side bars. If desired or necessary, such straps 44 may be provided at a plurality of places along the panel.

As shown in FIGS. 2 and 5, to protect the patient from being pinched as the hinges operate and to protect the panel from being soiled, the panel may be covered by a cloth cover which may be padded in a conventional manner.

As a result of the structure so far described, when the patient, normally lying on his back, reaches up with his hand to grasp the top edge 32 of the panel 30, the upper section 36 collapses inward of the bed. The patient will sense that this is an insecure structure to work up onto and, because the edge pivots inwardly of the bed, he will not have sufficient leverage to attempt to raise himself. This will discourage the patient from attempting to climb over the panel and he will remain on his back in bed probably repeatedly flopping the upper section inwardly, allowing it intermittently to restore to planar position. Repetition of this movement by the patient is to be expected and a harmless exercise.

It has been empirically determined that the width of the upper section should be at least 3" for best results. A narrower width may be easily grasped by the hand and the patient may still be able to use the section to exit the bed by pulling himself up.

It should be noted that Alzheimer's patients are not possessed of the cognitive ability to attempt to climb out of bed by turning over to lie on their chest, moving to a kneeling position and then attempting to climb over the panel. This would involve too complicated a thought process and, hence, the patient remains on his back as described.

There is thus described a simple foolproof means of discourage mentally impaired patients from attempting to climb out of bed. The panel is easily installed and readily moved and stored. Being a planar structure, it is compact and may be stored stacked against like panels.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. In combination with a bed having side bars on at least one side of the bed, a vertical panel extending along said side of the bed and secured against the side bars, the panel having a top edge and comprising a lower section and an upper section, proximate edges of the respective sections meeting in a horizontal hinge line, the upper and lower sections each being rigid, the upper and lower sections being normally coplanar and having proximate edges hinged together at the hinge line by at least one hinge including a bias adapted to bias the panels in coplanar condition but permitting the upper section to pivot and collapse inwardly of the bed about the hinge line to discourage attempts by a patient to grasp the top edge of the panel and use it to climb out of bed.

2. A panel as claimed in claim 1 wherein the upper section and hinge are covered by padding.

3. A panel as claimed in claim 1 wherein the hinge has a built-in spring coil disposed axially of the hinge.

4. A panel as claimed in claim 1 wherein the upper section has a vertical height of at least three inches.

5. A panel as claimed in claim 1 wherein the upper section has a height greater than can be comfortably grasped by a hand.

6. A panel as claimed in claim 1 wherein securing means secure the panel against the side bars.

7. A panel as claimed in claim 1 wherein the securing means comprises a strap.

8. For installation along a side of a hospital bed a vertical side panel having hinged thereto an inwardly collapsible upper section and means for biasing the upper section toward a vertical uncollapsed state.

9. A patient-protective device comprising a vertical panel adapted to extend along a side of a bed having side bars and secured against the side bars, the panel having a top edge and comprising a lower section and an upper section, proximate edges of the respective sections meeting in a horizontal hinge line, the upper and lower sections each being rigid, the upper and lower sections being normally coplanar, and having proximate edges hinged together by at least one hinge, bias means adapted to bias the panels in coplanar condition but permitting the upper section to pivot and collapse inwardly of the bed about the hinge line to discourage attempts by a patient to climb out of bed.

* * * * *